US010306972B2

(12) United States Patent
Mendez et al.

(10) Patent No.: US 10,306,972 B2
(45) Date of Patent: Jun. 4, 2019

(54) SECUREMENT APPARATUS HAVING A CONCEALED STRUCTURAL COMPONENT

(71) Applicant: Apple Inc., Cupertino, CA (US)

(72) Inventors: Javier Mendez, Cupertino, CA (US); Craig M. Stanley, Cupertino, CA (US); Tyler S. Bushnell, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 96 days.

(21) Appl. No.: 15/166,204

(22) Filed: May 26, 2016

(65) Prior Publication Data

US 2017/0340093 A1 Nov. 30, 2017

(51) Int. Cl.
*A45F 5/00* (2006.01)

(52) U.S. Cl.
CPC ..... *A45F 5/00* (2013.01); *A45F 2005/006* (2013.01); *A45F 2005/008* (2013.01); *A45F 2200/055* (2013.01); *A45F 2200/0508* (2013.01); *A45F 2200/0516* (2013.01)

(58) Field of Classification Search
CPC ..... A45F 2005/006; A45F 2005/008; A45F 5/00; A45F 2200/0508; A45F 2200/0516; A45F 2200/055
USPC ..... 224/600, 602, 219–222, 254–258, 267, 224/178
See application file for complete search history.

(56) References Cited

U.S. PATENT DOCUMENTS 1,904,230 A * 4/1933 Hildebrand ..... A44C 5/22 224/164
2,023,379 A * 12/1935 Bullard ..... D03D 49/36 139/161 S
2,266,953 A * 12/1941 Blue ..... A41F 9/002 156/104
2,573,055 A * 10/1951 Pedersen ..... A44C 5/0053 224/178
3,469,749 A * 9/1969 Tabata ..... A44C 5/0053 224/178
4,513,896 A * 4/1985 Hirsch ..... A44C 5/0053 224/178
6,345,747 B1 * 2/2002 Ogata ..... A45C 13/18 224/257
9,060,588 B2 6/2015 Bransfield et al.
2005/0109809 A1 * 5/2005 Yagi ..... A01K 97/06 224/660
2012/0012625 A1 * 1/2012 Foell ..... A63C 11/222 224/267
2014/0004763 A1 * 1/2014 Whitley ..... A45F 5/02 442/1
2014/0185856 A1 7/2014 Koss, Jr. et al.
(Continued)

*Primary Examiner* — Scott T McNurlen
(74) *Attorney, Agent, or Firm* — Morgan, Lewis & Bockius LLP

(57) ABSTRACT

Disclosed herein is a securement apparatus, such as a lanyard, that has increased tensile strength and shear strength when compared with a conventional securement apparatus. The securement apparatus includes a connector extending from a connector body, a strap coupled to the connector body, and a structural component. The structural component has a tapered geometry such that a first end that is contained within the connector body has a first width and/or height and a second end that transitions from the connector body into the strap has a second width and/or height that is less than the first width and/or height.

15 Claims, 5 Drawing Sheets

(56) References Cited

U.S. PATENT DOCUMENTS

2015/0320128 A1* 11/2015 Yoo ..... A41D 20/00
2/170
2015/0370224 A1* 12/2015 Emmert ..... A44C 5/14
224/164

* cited by examiner

SECUREMENT APPARATUS HAVING A CONCEALED STRUCTURAL COMPONENT

FIELD

The described embodiments relate generally to a securement apparatus. The securement apparatus may be a lanyard or other such mechanism that may be used to secure an object to an individual. The securement apparatus of the present disclosure includes a concealed structural component having a shape that decreases or eliminates discontinuities in the stiffness between different portions of the securement apparatus while providing increased tensile strength and shear strength.

BACKGROUND

Lanyards, and other types of securement apparatuses, are typically used to secure one or more objects to an individual. For example, a lanyard is typically worn around a neck, shoulder, arm, or wrist of an individual and may be used to carry keys, access or identification cards, and so on. In other examples, lanyards may be used to secure a remote control, a gaming controller, and the like to the individual.

However, lanyards have a tendency to break or tear when an individual inadvertently or deliberately pulls or yanks on the straps of the lanyard. In other cases, the straps of the lanyard wear during use and thus be more susceptible to breaking. When the straps of the lanyard break, any object that is attached to the lanyard may be lost.

SUMMARY

Disclosed herein is a securement apparatus for securing an object to an individual. The securement apparatus of the present disclosure includes a structural component that increases tensile strength and shear strength of the securement apparatus. The structural component also has a shape that decreases or eliminates stiffness discontinuity between different portions of the securement apparatus. The securement apparatus may be a lanyard, a strap, a band, or any other mechanism that may be used to secure an object to an individual.

The present disclosure also describes a securement apparatus for an electronic device. The securement apparatus comprises a connector body, a connector extending from the connector body and operative to connect to the electronic device and a flexible strap coupled to the connector body. The securement apparatus also includes a structural component comprising a first end contained within the connector body, and a second end. The second end is opposite the first end and extends along and/or into the flexible strap and tapers such that the first end has a first dimension and the second end has a second dimension that is less than the first dimension. The first end may be within the connector body and the strap simultaneously, insofar as the strap may be received within the connector body.

Also disclosed is a securement apparatus comprising a cover portion and a strap having a first end and a second end. A first tapered component is contained within the cover portion and within the first end of the strap. A second tapered component is also contained within the cover portion and within the second end of the strap. Each of the first end and the second end are coupled to the cover portion and the first and second tapered components are configured to resist tearing of the strap.

Also disclosed is a lanyard for an electronic device. The lanyard includes a connector body defining a first side and a second side, a connector extending from the first side of the connector body and operative to removably attach the lanyard to the electronic device. The lanyard also includes a strap having first and second ends that are coupled to the second side of the connector body, thereby forming a loop. A first structural component is also included. The first structural component comprises a first head portion defining a first aperture and a first tapered body portion that extends along the first end of the strap. The lanyard also includes a second structural component that comprises a second head portion defining a second aperture and a second tapered body portion that extends along the second end of the strap. A pin mechanism is contained within the connector body and is coupled to the first structural component and the second structural component by the first aperture and the second aperture. The first structural component is configured to reduce a stiffness discontinuity of the first end of the strap and the second structural component is configured to reduce a stiffness discontinuity of the second end of the strap.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
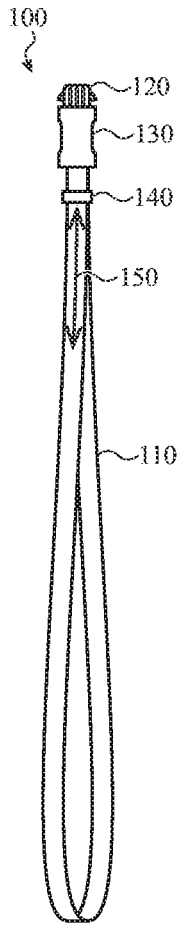
FIG. 1 illustrates an example securement apparatus that may use or incorporate a structural component such as described herein.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure is directed to a securement apparatus, such as, for example, a lanyard, a strap, a belt, a leash, a cord or any other attachment apparatus for securing an object to an individual. The securement apparatus includes a connector body. The connector body may be made of plastic, metal, rubber, or other material. A connector extends from the connector body and is configured to be secured to an object. For example, the connector may be inserted into or otherwise coupled to a remote control, a keycard, a key, or any other object. A flexible or bendable strap extends from a second end of the connector body. The strap may be used to secure the object to an individual. For example, the strap may be placed around a wrist, hand, arm, or shoulder of the individual. The term "strap" is generally intended to encompass any of the foregoing.

The securement apparatus also includes a structural component. The structural component may be contained, or otherwise concealed within, the securement apparatus. The structural component has a head portion and a body portion. The head portion is contained within the connector body. The body portion extends from the connector body into the strap. Insofar as the strap may be partially within the connector body, the strap may encompass or otherwise receive an entirety of the structural component (although this is not necessary). The structural component increases tensile strength and shear strength of the securement apparatus. As used herein, the term "tensile strength" means an amount of force required to pull an object until it breaks. The term "shear strength" means the amount of shear stress the object can withstand without rupturing or tearing (e.g., along a plane that is parallel to the direction of applied force on the object).

The structural component also decreases or eliminates discontinuities in the stiffness that may be present in the strap, and more specifically, at an interface between the strap and the connector body, as a result of the structural component extending from the connector body and into the strap. As used herein, the terms "stiffness discontinuity" and/or "discontinuities in stiffness" mean that a first portion of the securement apparatus is stiffer than a second portion of the securement apparatus. Any stiffness discontinuity may affect the feel of the securement apparatus (e.g., some portions of the flexible strap of the securement apparatus may be soft while other portions are hard, bend less readily, and/or have higher bend resistance), and it may also affect the aesthetics of the securement apparatus. For example, when the strap of the securement apparatus bends, the strap may have sharp or pronounced bend angles at a transition point within the strap where the structural component ends.

More specifically, the strap of the securement apparatus may be made from a soft, pliable material. Accordingly, the strap may be flexible or bendable. However, it may be relatively easy to inadvertently rip, tear or yank the strap out of the connector body. The structural component may be made from polyethylene terephthalate (PET). The harder PET material increases the tensile strength and shear strength of the strap.

However, due to the difference in the stiffness or the hardness between the structural component and the strap, a user may be able to feel, but not see, the structural component within the strap and/or feel where the structural component ends. In addition, when the strap is bent or is otherwise manipulated, the portions of the strap having the structural component have a higher bend resistance while the portions of the strap without the structural component are more pliable. As such, the strap may have a rigid bend at a transition point where the structural component ends.

In order to remedy this, the structural component has at least one dimension that gradually decreases along its length. For example, a width and/or a height of the structural component may gradually decrease along its length. Accordingly, the head portion of the structural component has a first width and/or height and the body portion of the structural component has a width and/or height that gradually decreases along its length to a second width and/or height. In some embodiments, the body portion may terminate at a point. As such, the shape of the structural component may be described as a teardrop shape or as having a tapered geometry.

The decrease in the width and/or height from the head portion to the end of the body portion may be linear or substantially linear. In other embodiments, the decrease in the width and/or the height from the head portion to the end of the body portion may be a sawtooth, a stair-step, a sinusoid or other curve, and so on. In some implementations, the tapered geometry of the structural component may be caused by stacking and/or placing different layers of material on top of one another and/or adjacent one another.

Due to the tapered geometry of the structural component, the body portion of the structural component is pliable. Accordingly, any stiffness discontinuity between different portions of the securement apparatus, such as, for example, a portion of the strap in which the structural component is contained and a portion of the strap in which the structural component is not contained, may be reduced or eliminated.

These and other embodiments are discussed below with reference to FIGS. 1-6. However, those skilled in the art will readily appreciate that the detailed description given herein with respect to these Figures is for explanatory purposes only and should not be construed as limiting.

FIG. 1 illustrates an example securement apparatus 100. As will be described herein, the securement apparatus 100 may include a structural component (e.g., a reinforcement structure) that increases the tensile strength and shear strength of the securement apparatus 100 while reducing or eliminating stiffness discontinuity between various portions of the securement apparatus 100. In one example embodiment, the securement apparatus 100 is a lanyard. Although a lanyard is shown in FIG. 1, the securement apparatus 100 may be a strap, a band, a leash, a belt, a cord, or any such device that may be used to secure an object to an individual.

The securement apparatus 100 may include a strap 110, a connector 120, and a connector body 130. The connector 120 may extend from the connector body 130 and may be used to removably secure or couple the securement apparatus 100 to an object.

The strap 110 may be a single strap having a first end and a second end. Each of the first end and the second end may be coupled to the connector body 130 or otherwise extend from the connector body 130 such that the strap 110 forms a loop. The loop may then be secured to an individual. For example, the individual may place her arm, wrist, hand, or shoulder in the loop to carry or hold the object that is attached to the securement apparatus 100.

In some instances, the strap 110 may be flexible or bendable. As such, the strap 110 may be made from a pliable material such as, for example, rubber, leather, polyurethane, microfiber, or other such materials. The pliable material may provide a level of comfort to the individual when the strap 110 is secured to the individual. In some instances, a first side of the strap 110 is made from a first material while a second side of the strap 110 is made from a second, different material.

The securement apparatus 100 may also include a sliding mechanism 140. The sliding mechanism 140 may move along the strap 110 in the direction of arrow 150 in order to tighten or loosen the strap 110 on the individual.

Figure 2:
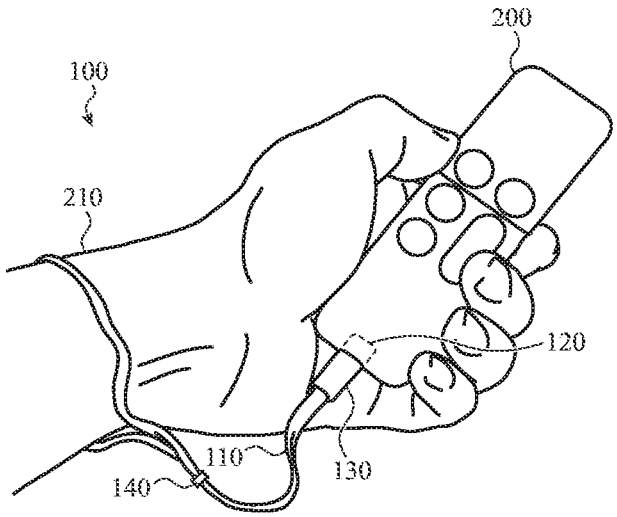
FIG. 2 illustrates the example securement apparatus of FIG. 1 attached to an example remote control and secured to an individual.

FIG. 2 illustrates the example securement apparatus 100 of FIG. 1 attached to an example remote control 200 and also secured to an individual. In this example embodiment, the connector 120 is used to removably attach the securement apparatus 100 to the remote control 200. For example, the connector 120 may be inserted into a receiving port of the remote control 200. The strap 110 may then be wrapped around a wrist 210 of the individual. The individual may use the sliding mechanism 140 to loosen or tighten the strap 110 around her wrist 210.

Although a remote control 200 is specifically shown, the securement apparatus 100 may be used with a variety of electronic devices and other objects. For example, the securement apparatus 100 may be removably coupled to a telephone, a tablet computer, a portable music player, an identification card, an access key, car keys, a wallet, or any other object.

Regardless of the device or object the securement apparatus 100 is coupled to, a structural component contained within the connector body 130 and extending along or otherwise within the strap 110 increases the tensile strength and the shear resistance of the securement apparatus 100. The structural component may be fully within the strap 110 or only partially within the strap 110. Thus, when the object, such as the remote control 200, is being held or is otherwise being used or carried by the individual, there may be less risk of the strap 110 tearing or being yanked or pulled out of the connector body 130.

Figure 3A:
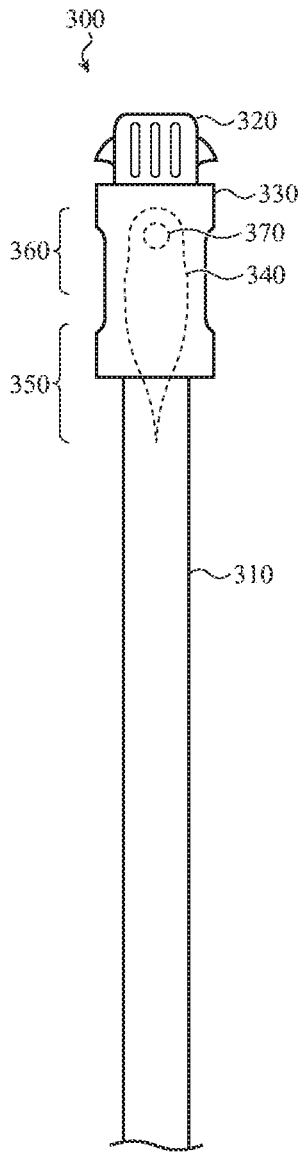
FIG. 3A illustrates a first example structural component contained within an example securement apparatus.

FIG. 3A illustrates an example structural component 340 that may be contained within a securement apparatus 300. The securement apparatus 300 may be similar to the securement apparatus 100 shown and described above with respect to FIGS. 1-2. Accordingly, the securement apparatus 300 may include a flexible strap 310, a connector 320, and a connector body 330. The connector 320 may extend from a first side of the connector body 330 and be used to removably couple the securement apparatus 300 to an object. The strap 310 may extend from a second side of the connector body 330. In some implementations, the strap 310 may be a single unitary piece in which a first end of the strap 310 is connected to a first portion of the connector body 330 and a second end of the strap 310 is connected to a second portion of the connector body 330 such that the strap 310 forms a loop. The connector body 330 may be made of plastic, rubber, metal, or other material. The connector 320 and the strap 310 may function in a similar manner such as described above.

The strap 310 may be made from a pliable material. For example, the strap 310 may be made from cloth, leather, rubber, polyurethane, microfibers, and so on. While these materials may be soft and/or comfortable when the strap 310 is worn by the individual, these materials are also susceptible to ripping or tearing—especially at the point where the strap 310 is coupled to, or otherwise extends from, the connector body 330.

Figure 3B:
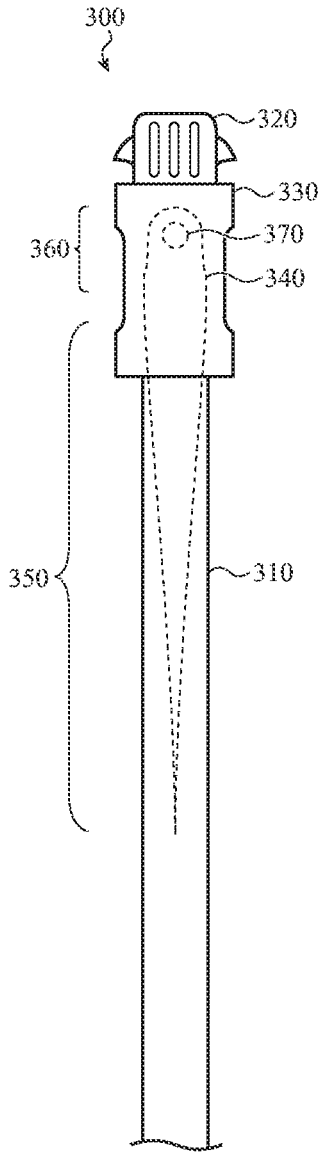
FIG. 3B illustrates a second example structural component contained within an example securement apparatus.

Accordingly, the securement apparatus 300 includes a structural component 340 that is integrated with, or otherwise affixed to, the connector body 330 and the strap 310. The structural component 340 is configured to resist tearing of the strap 310. In some embodiments, the structural component 340 is entirely contained within the strap 310 and/or the connector body 330 such that it is not visible to a user. For example, the structural component may be fully within the strap and a portion of the strap may be contained within the connector body, such that the structural component is partly within the connector body and partly outside the connector body as shown in FIGS. 3A and 3B.

The structural component 340 may be made from PET although other materials may be used. The structural component 340 may be coupled or adhered to one or more inner surfaces of the strap 310 which increases the tensile strength and shear resistance of the securement apparatus 300. For example, the stiffness or the hardness of the structural component 340 makes the strap 310 more resistant to being yanked out of the connector body 330 and also makes it harder to tear or rip the strap 310. However, in the event the securement apparatus 300 gets caught on an object or is at risk for harming the user, the structural component 340 and/or the strap 310 are configured to break when a threshold amount of force is provided to the securement apparatus 300.

The structural component 340 includes a first portion, also referred to as a head portion 360 and a second portion also referred to as body portion 350. The body portion 350 may extend from the head portion 360 and form a unitary structure. The head portion 360 may have a first dimension and/or shape. For example, the head portion 360 may be rounded and have a first width. The body portion 350 may have a second dimension and/or shape. For example, the body portion 350 may have a second width that is less than the first width. As such, the structural component 340 is tapered in at least one plane or dimension. However, the structural component 340 can also be tapered in another plane or dimension. For example, the head portion 360 may have a first height and the body portion 350 has a second height that is less that the first height.

More specifically, the width and/or the height of the structural component 340 gradually decreases along its length from the head portion 360 to the body portion 350. In some embodiments, the decrease in the width and/or the height may be gradual along a first portion of the body portion 350 and become more pronounced toward the end of the body portion 350. The decrease in the width and/or the height may be linear or substantially linear. In other implementations, the structural component 340 may be a stairstep, a sawtooth, a sinusoid or any other non-linear configuration along its length. For example, different layers of a PET film or other materials having different lengths and/or widths may be stacked on top of one another to provide the tapered geometry.

The head portion 360 may be entirely contained within the connector body 330 (and, optionally, also within the strap 310). The body portion 350 may be partially contained within the connector body 330 and extend into and/or along the strap 310, outside of the connector body. In some embodiments, one end of the body portion 350 may extend into and/or along the strap 310 such as shown in FIG. 3A. More specifically, the tapered section of the body portion 350 of the structural component 340 may be pointed away from the connector body 330 and toward a middle or center portion of the strap 310, as well as being positioned outside the connector body. In some instances, the structural component 340 may be entirely contained with the connector body 330 and the strap 310 such that the structural component 340 is hidden from view.

In some embodiments, a majority of the length of the body portion 350 may extend into and/or along the strap 310 such as shown in FIG. 3B. In yet another embodiment, the body portion 350 may have a length that extends the entire length of the strap 310. In each embodiment, a width and/or a height of the body portion 350 may decrease along its length.

Although the structural component 340 increases the durability of the securement apparatus 300, it may not be desirable to have a first portion of the strap 310 look thicker, bend differently or feel different from a second portion of the strap 310. For example, the portion of the strap 310 that includes the body portion 350 of the structural component 340 may be more stiff than a portion of the strap 310 that does not include the body portion 350. Likewise, the portion of the strap 310 that includes the body portion 350 may bend differently (e.g., have more pronounced bend angles) than the portion of the strap 310 that does not include the body portion 350.

In order to reduce or eliminate any stiffness discontinuity between various portions of the strap 310, the structural component 340 has the tapered geometry such as described above. The tapered geometry enables one portion of the structural component 340 to have a first rigidity while a second portion of the structural component 340 has a second rigidity that is less than the first rigidity. For example, the head portion 360 of the structural component 340 may have a first rigidity while the body portion 350 of the structural component 340 is more pliable. As described above, as the width and/or the height of the body portion 350 decreases along its length, it becomes more pliable. Thus, the head portion 360 may act to increase the tensile strength of the strap 310 while the body portion 350 may bend and move with the strap 310 as it has a smaller width and/or height.

The head portion 360 may define an aperture 370. The aperture 370 may receive a pin or other attachment mechanism that couples the strap 310 to the connector body 330. The pin may also be used to secure structural component 340 to the strap 310.

In some implementations, the connector body 330 may have a recess or an aperture that receives one or both ends of the strap 310 and the pin. The strap 310 may then extend from the connector body 330 such as shown. In another embodiment, the connector body 330 may be press-fit or molded over the pin and the strap 310.

Figure 4A:
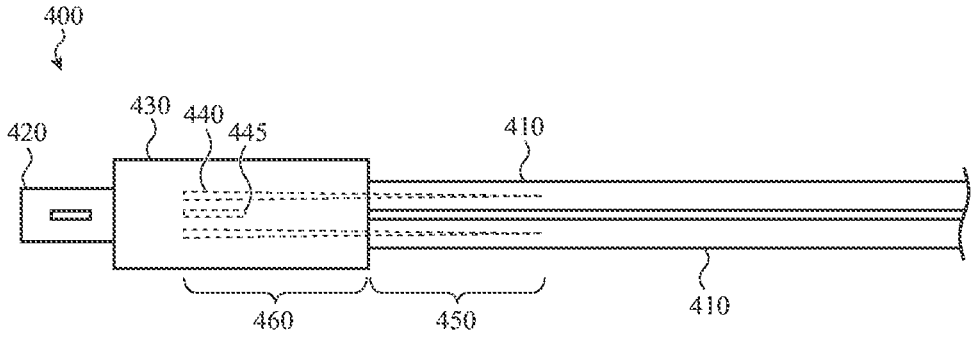
FIG. 4A illustrates a side view of an example securement apparatus having a structural component.

FIG. 4A illustrates a side view of an example securement apparatus 400 or lanyard having a reinforcement structure taking the form of a tapered component 440. The securement apparatus 400 may be similar to the securement apparatus 100 shown and described above with respect to FIGS. 1-2 and the securement apparatus 300 described above with respect to FIGS. 3A-3B. Likewise, the tapered component 440 may be similar to the structural components described above.

The securement apparatus 400 may include a cover portion 430 (which may be similar to, or the same as, the aforementioned connector body), a connector 420 extending from a first side of the cover portion 430 and a strap 410 extending from a second side of the cover portion 430. The cover portion 430 is configured to be held by a user when the user connects the securement apparatus 400 to an object. The cover portion 430 may also conceal the one or more ends of the strap 410 and the tapered component 440. For example, the strap 410 may be a unitary strap 410 having a first end that is coupled to a first portion of the cover portion 430 and a second end that is connected to a second portion of the cover portion 430. Although the strap 410 is described as a unitary strap, in other embodiments, the strap 410 may be formed from multiple segments.

The securement apparatus 400 also includes a tapered component 440. More specifically, each end of the strap 410 that is coupled to the cover portion 430 has an integrated tapered component 440. The tapered component 440 has a first portion 460 and a second portion 450. The first portion 460 may be contained within or otherwise be coupled to the cover portion 430. The second portion 450 may be partially contained within the cover portion 430 and also within the strap 410. In some embodiments, the first end of the strap 410 and the second end of the strap 410 may also be at least partially contained within the cover portion 430.

The securement apparatus 400 also includes a reinforcement component 445. The reinforcement component 445 may be positioned or otherwise sandwiched between each of the tapered components 440. The reinforcement component 445 may be made from the same material as the tapered components 440 and be used to further increase the tensile strength of the securement apparatus 400.

The tapered component 440 may be used to increase the tensile strength and the shear strength of the securement apparatus 400. The tapered component 440 may have a tapered geometry such as described above. In some instances, an end or point of the tapered component 440 may be pointed away from the cover portion 430 and into the strap 410. The tapered geometry acts to reduce or eliminate stiffness discontinuity that may be present in the strap 410.

Figure 4B:
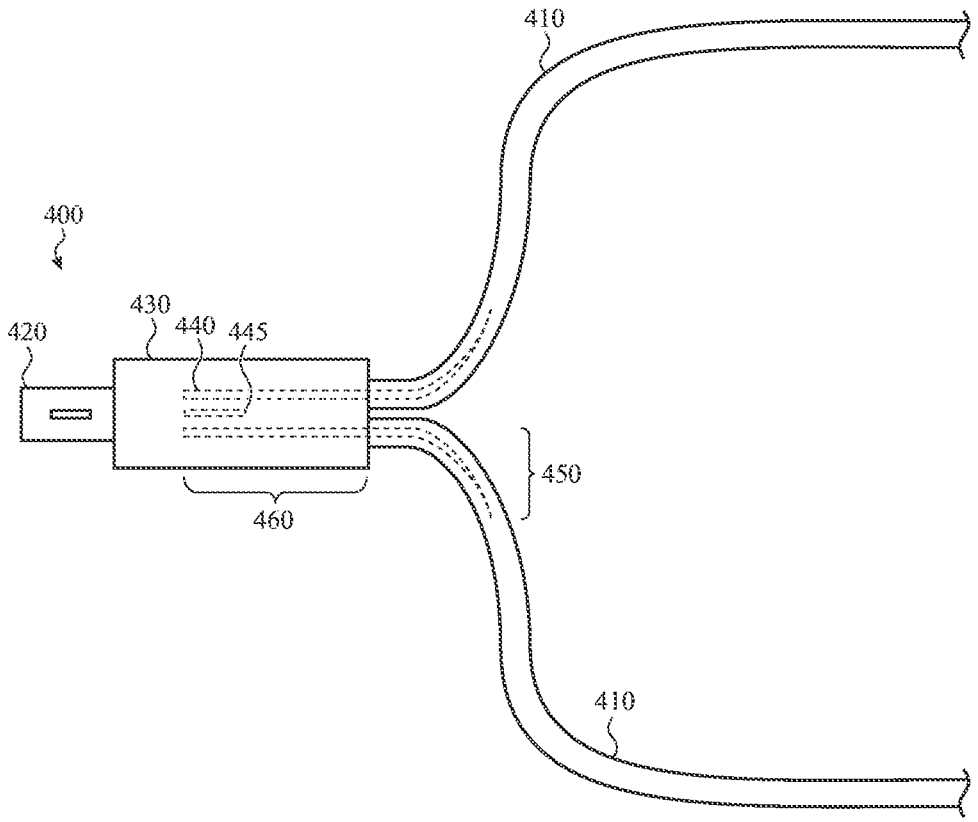
FIG. 4B illustrates a side of an example securement apparatus in which the structural component reduces or otherwise eliminates stiffness discontinuity between different portions of the securement apparatus.

For example, and as shown in FIG. 4B, the tapered geometry of the second portion 450 of the tapered component 440 enables the tapered component 440 to bend along with the strap 410. As such, the strap 410 has a rounded and continuous bend, even in the portions of the strap 410 that include the second portion 450 of the tapered component 440. More specifically, as one or more dimensions of the second portion 450 get smaller due to the taper, the bend resistance of the tapered component 440 decreases. As the bend resistance decreases, the second portion 450 of the tapered component 440 exhibits the rounded and continuous bend shown in FIG. 4B.

Figure 5:
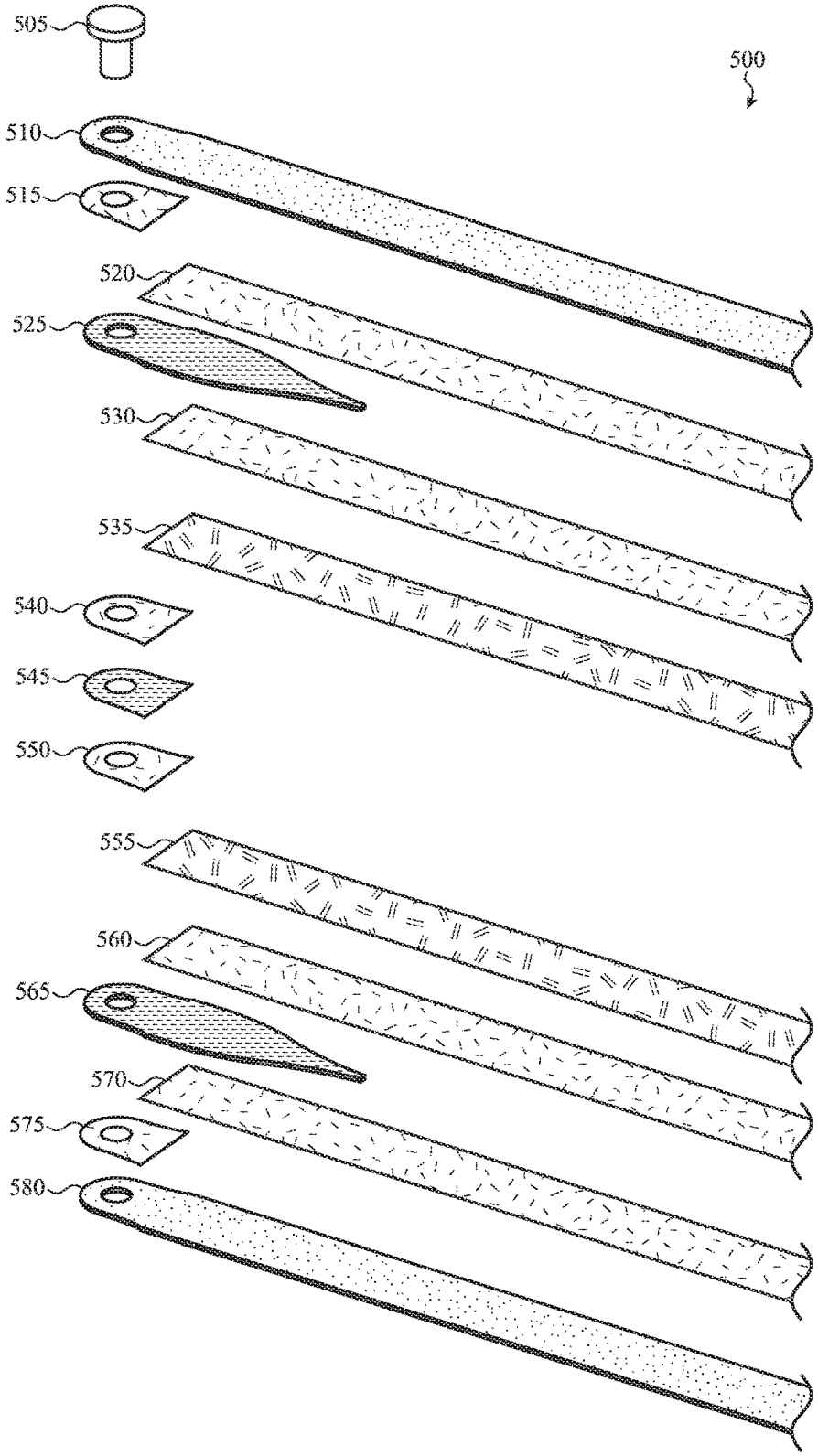
FIG. 5 illustrates an exploded perspective view of an example securement apparatus.

FIG. 5 illustrates an exploded perspective view of an example securement apparatus 500. The securement apparatus 500 may be similar to the securement apparatuses or lanyards previously described herein. Accordingly, the securement apparatus may include a connector, a connector body, and a strap. However, for clarity purposes, the connector body and the connector are omitted from FIG. 5. Additionally, the embodiment depicted in FIG. 5 illustrates first and second ends of the same strap.

The strap of the securement apparatus 500 may be made from various layers. Each of the layers may be pressed together, or otherwise formed into a single strap. In one embodiment, the strap of the securement apparatus may include a first outer layer 510. The first outer layer 510 may be made from a pliable material. In one specific example, the first outer layer 510 may be polyurethane. In another embodiment, the first outer layer 510 may be nylon, rubber, leather, or other pliable material. The first outer layer 510 may define an aperture in which a pin mechanism 505 may be placed.

The securement apparatus 500 also includes adhesive layers 515 and 520. Adhesive layers 515 and 520 may be used to couple the first outer layer 510 to a first side of a first structural component 525. For example, adhesive layer 515 may be used to couple a head portion of the first outer layer 510 to a head portion of the first structural component 525 and adhesive layer 520 may be used to couple the remaining portion of the first outer layer 510 to the body portion of the first structural component 525. Although adhesive layers 515 and 520 are shown as separate adhesive layers, each of the adhesive layers 515 and 520 may be a single layer. In addition, although an adhesive layer is specifically mentioned, a film or other coupling substance may be used to couple the first outer layer 510 to the first structural component 525.

The first structural component 525 may be similar to the structural components described herein. For example, the structural component 525 may be similar to the structural component 340 of FIGS. 3A-3B and the tapered component 440 of FIGS. 4A-4B. Accordingly, the first structural component 525 may have a tapered geometry with respect to its width and/or height.

The securement apparatus 500 may also include a first inner layer 535. The first inner layer 535 may be made from a microfiber, a fabric, or other material. In some embodiments, the first inner layer 535 may be made from the same material as the first outer layer 510. The first inner layer 535 may be coupled and secured to a second side of the first structural component 525 using an adhesive layer 530. The adhesive layer 530 and the adhesive layer 520 may also be coupled to each other such that the first structural component 525 is sandwiched between these layers. Additionally, the adhesive layer 530 and the adhesive layer 520 may be coupled to each other and ultimately couple the first outer layer 510 to the first inner layer 535.

The securement apparatus 500 also includes a reinforcement component 545. The reinforcement component 545 may be made from a similar material as the first structural component 525. For example, the reinforcement component 545 may be made from PET. The reinforcement component 545 may be used to further increase the tensile strength of the securement apparatus 500. In some embodiments, the reinforcement component 545 may be omitted.

The reinforcement component 545 may be coupled to the first structural component 525 by an adhesive layer 540. Another adhesive layer 550 may be used to couple a second side of the reinforcement component 545 to a first side of a second structural component 565.

The securement apparatus 500 may also include a second inner layer 555. In some instances, such as when the strap is a single unitary piece, the second inner layer 555 is an extension of the first inner layer 535. As such, the second inner layer 555 may be made from the same material as the first inner layer 535. The second inner layer 555 is coupled to a first side of the second structural component 565 using an adhesive layer 560. The second structural component 565 is also coupled to a second outer layer 580 using adhesive layers 570 and 575. Adhesive layers 570 and 575 may be similar to adhesive layers 515 and 520. Just as the second inner layer 555 is an extension of the first inner layer 535, the second outer layer 580 may be an extension of the first outer layer 510.

Each of the first outer layer 510, adhesive layers 515, 540, 550 and 575, the first structural component 525, the reinforcement component 545, the second structural component 565 and the second outer layer 580 may each define an aperture. These apertures may receive the pin mechanism 505 that further secures each of these layers together. In addition, the pin mechanism 505 may be used to secure all of the constructed layers of the strap within a connector body of the securement apparatus 500. For example, the connector body of the securement apparatus may include a recess that receives the pin mechanism 505.

In some embodiments, a width of each of the layers may be equivalent or substantially equivalent to one another. For example, the first outer layer 510 may have a width that is equivalent or substantially equivalent to the adhesive layer 520. Likewise, a width of a portion of the first structural component 525 (e.g., a head portion and/or at least a portion of the body portion) may be equivalent or substantially equivalent to a width of the first outer layer 510 and the first inner layer 535.

In some embodiments, each of the first structural component 525 and the second structural component 565 have a thickness of approximately 0.05 mm to approximately 0.5 mm, although other values may be used. The reinforcement component 545 may have a thickness of approximately 0.05 mm to approximately 0.1 mm, although other values may be used.

In some embodiments, thicknesses of the first structural component 525 and/or the second structural component 565 may change from a first end to a second end. For example, the head portion of the first structural component 525 may have a thickness of approximately 0.5 mm while the body portion has a thickness of approximately 0.05 mm.

In such embodiments, the thickness or the height of each of the first structural component 525 and the second structural component 565 may gradually decrease along its length. For example, as the width of the first structural component 525 decreases along its length, the thickness of the first structural component 525 also decreases along its length.

As discussed above, the pin mechanism 505 may be used to secure the strap of the securement apparatus 500 within the connector body. However, the pin mechanism 505 may also be used to ensure the one or more straps of the securement apparatus 500 break when a particular amount of force is provided on the securement apparatus.

For example, the securement apparatus 500, and more specifically the first structural component 525 and/or the second structural component 565 are configured to rip, tear or otherwise break when a threshold amount of force is applied to the securement apparatus. This is primarily for user safety. For example, if a user has secured the securement apparatus 500 around her wrist and the securement apparatus gets caught on an object or could otherwise cause harm to the user, the straps of the securement apparatus 500 are configured to tear, rip or break, such that the user is able to remover her wrist from the securement apparatus 500. In some embodiments, the structural components 525 and 565 are configured to break near the aperture that receives the pin mechanism 505.

Figure 6:
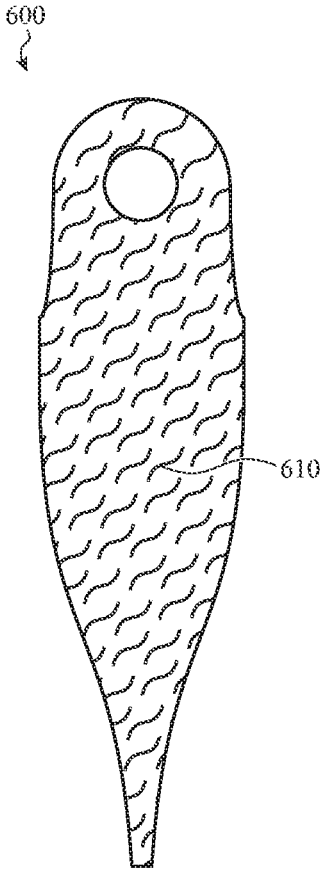
FIG. 6 illustrates a plan view of a structural component that may be used or incorporated by a securement apparatus.

FIG. 6 illustrates a plan view of a structural component 600 that may be used or incorporated by a securement apparatus. The structural component 600 may be similar to any of the structural components described above. Accordingly, the structural component 600 has a tapered geometry such as described above. For example, the structural component 600 has a first end and a tapered second end. The second end is opposite the first end such as shown in FIG. 6.

As discussed above, the structural component 600 may be used to increase the tensile strength and shear strength of a securement apparatus. As such, the structural component 600 may be made from PET or other such material. The structural component 600 may also include various strands 610. These strands 610 may be carbon strands that are present in the PET when the structural component 600 is manufactured. In some embodiments, additional strands may be inserted into the structural component 600. The additional strands may be glass fiber strands or additional carbon fiber strands that act to further increase the tensile strength provided by the structural component 600.

In some embodiments, the alignment of the strands 610 may be set during the manufacturing process. For example, during the manufacturing process, the roll direction of the PET may be used to align the strands 610 in a particular orientation. The alignment of the strands 610 may also affect the tensile strength of the structural component 600.

In some embodiments, the structural component 600 is manufactured such that the strands 610 are offset from a longitudinal axis or transverse axis of the structural component 600. In other embodiments, the structural component 600 is manufactured such that the strands 610 are aligned with either the longitudinal axis or transverse axis of the structural component 600. This may increase a resistance of the structural component to tearing, ripping, or otherwise separating under force along the longitudinal and/or transverse axes of the component.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A securement apparatus for an electronic device, comprising:
- a connector body;
- a connector extending from the connector body and operative to connect to the electronic device;
- a flexible strap coupled to the connector body and having a first end and a second end coupled to the connector body, the connector body having a maximum dimension that is larger than a maximum dimension of the flexible strap;
- a structural component within the flexible strap and tapering from a maximum dimension of the structural component within the connector body to a point within the flexible strap and outside the connector body; and
- a pin mechanism coupled to the first end of the strap and the second end of the strap and operative to secure the flexible strap within the connector body.

2. The securement apparatus of claim 1, wherein the maximum dimension of the structural component is a width of the structural component.

3. The securement apparatus of claim 1, wherein the maximum dimension of the structural component is a height of the structural component.

4. The securement apparatus of claim 1, wherein the structural component further comprises strands arranged in an orientation that is offset from both a longitudinal axis and a transverse axis of the structural component.

5. The securement apparatus of claim 1, wherein the pin mechanism is received in an aperture defined by an end of the structural component.

6. The securement apparatus of claim 1, further comprising:
- a first adhesive layer positioned between a first side of the structural component and a first side of the flexible strap; and
- a second adhesive layer positioned between a second side of the structural component and a second side of the flexible strap.

7. A securement apparatus, comprising:
- a cover portion; and
- a strap, comprising:
  - a first end coupled to the cover portion;
  - a second end coupled to the cover portion;
  - a first tapered component extending within the cover portion and the first end of the strap;
  - a second tapered component extending within the cover portion and the second end of the strap; and
  - a reinforcement component positioned between the first tapered component and the second tapered component, wherein the reinforcement component defines an aperture for receiving a pin mechanism;
  - wherein the first tapered component and the second tapered component each have a teardrop shape and are configured to resist tearing of the strap.

8. The securement apparatus of claim 7, further comprising the pin mechanism being coupled to the first end of the strap and the second end of the strap, and operative to secure the strap within the cover portion.

9. The securement apparatus of claim 7, wherein the reinforcement component has a thickness of 0.05 mm to 0.1 mm.

10. The securement apparatus of claim 7, wherein the first tapered component and the second tapered component each have a thickness of 0.05 mm to 0.5 mm.

11. The securement apparatus of claim 7, further comprising a connector extending from the cover portion and operative to secure the cover portion and the strap to an electronic device.

12. The securement apparatus of claim 7, wherein:
- the strap comprises:
  - a first material on a first side of the strap;
  - a second material on a second side of the strap; and
  - a portion of each of the first material and the second material are coupled to respective portions of the first tapered component and the second tapered component using an adhesive.

13. A lanyard for an electronic device, comprising:
- a connector body defining a first side and a second side;
- a connector extending from the first side of the connector body and operative to removably attach the lanyard to the electronic device;
- a strap having first and second ends coupled to the second side of the connector body, thereby forming a loop;
- a first structural component, comprising:
  - a first head portion defining a first aperture; and
  - a first tapered body portion extending along the first end of the strap;
- a second structural component, comprising:
  - a second head portion defining a second aperture;
  - a second tapered body portion extending along the second end of the strap;
  - a pin mechanism contained within the connector body and coupled to the first structural component and the second structural component by the first aperture and the second aperture; and
  - a reinforcement component positioned within the connector body and between the first head portion of the first structural component and the second head portion of the second structural component, wherein the reinforcement component is coupled to the first head portion of the first structural component and the second head portion of the second structural component by an adhesive.

14. The lanyard of claim 13, wherein the strap comprises:
- a first material coupled to a first side of the first tapered body portion and a first side of the second tapered body portion; and
- a second material coupled to a second side of the first tapered body portion and a second side of the second tapered body portion.

15. The lanyard of claim 13, wherein at least a portion of the first tapered body portion and at least a portion of the second tapered body portion are contained within the connector body.

* * * * *